US005160280A

United States Patent [19]

Chuang

[11] Patent Number: 5,160,280

[45] Date of Patent: Nov. 3, 1992

[54] ELECTRONIC PLUG

[76] Inventor: Tung-Hsien Chuang, No. 752, Min Tsu 1rd Rd., Kaohsiung City, Taiwan

[21] Appl. No.: 791,144

[22] Filed: Nov. 13, 1991

[51] Int. Cl.[5] ..... H01R 13/00

[52] U.S. Cl. ..... 439/675

[58] Field of Search ..... 439/589, 603, 625, 675, 439/668, 669, 702–707, 722

[56] References Cited

U.S. PATENT DOCUMENTS 2,700,144 1/1955 Flanagan, Jr. ..... 439/603

3,585,575 6/1971 Devito ..... 439/668

FOREIGN PATENT DOCUMENTS 288992 11/1988 European Pat. Off. ..... 439/589

*Primary Examiner*—Joseph H. McGlynn

*Attorney, Agent, or Firm*—Bacon & Thomas

[57] ABSTRACT

An electronic plug having an outer tube made of two different diametrical metal tubes joined together, an insulator extending through the interior of the outer tube and protruding out of both ends of the tube, a conductive member having a forked rear portion fixed lengthwise in the insulator, and the outer tube having another conductive member extending down from its front end as one unit is disclosed. In a second embodiment, the outer tube is made from a single metal tube.

3 Claims, 2 Drawing Sheets

ELECTRONIC PLUG

BACKGROUND OF THE INVENTION

Common conventional plugs used in electronic appliances generally have a cylindrical shape or a non-straight cylindrical shape. Straight cylindrical plugs have been found to have economical production advantages. As for non-straight cylindrical-shaped plugs, they have not yet been improved because of their cheap cost.

SUMMARY OF THE INVENTION

The electronic plug of the present invention comprises an outer metal tube made of two portions of different diameters connected firmly together with an interior insulator protruding out of the outer tube a little at both ends, and a conductive member having a forked rear portion fixed lengthwise in the whole body of the insulator and having its front end protruding out of the front end of the insulator as a terminal in order to connect a wire, and the outer tube also has a conductive member projecting down from its front end as another terminal for connecting a wire.

DETAILED DESCRIPTION OF THE INVENTION

Figure 1:
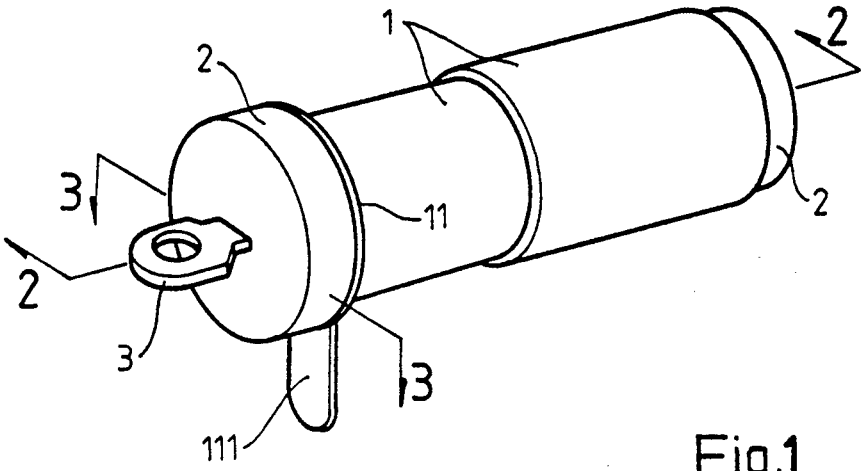
FIG. 1 is a perspective view of the electronic plug in the present invention.
Figure 2:
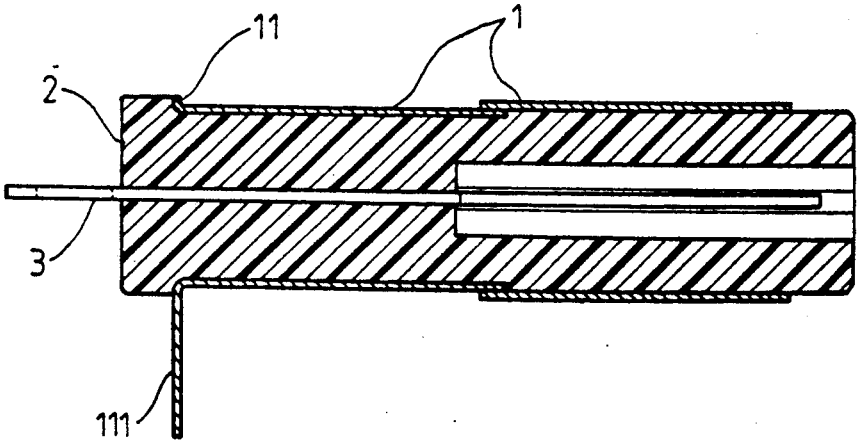
FIG. 2 is a cross-sectional view along 2—2 line in FIG. 1.
Figure 3:
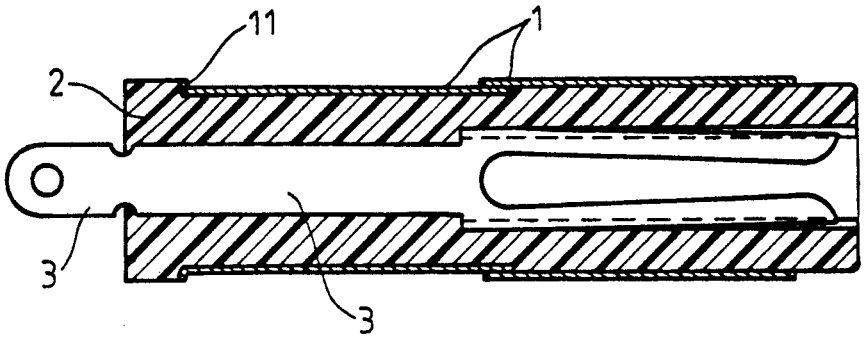
FIG. 3 is a cross-sectional view along 3—3 line in FIG. 1.
Figure 4:
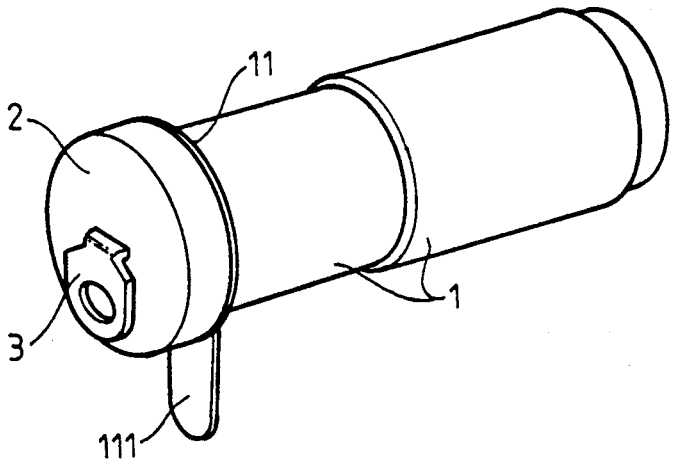
FIG. 4 is a perspective view of another embodiment of an electronic plug according to the present invention.

The electronic plug of the present invention, as shown in FIGS. 1-3, comprises an outer tube 1, an insulator 2 and a conductive member 3 as its main components.

The outer tube 1 consists of two portions of metal tubes having different diameters combined firmly together. The front end of the outer tube 1 has a projecting circumferential edge 11.

The insulator 2 is solidly mounted in the interior of the outer tube 1, having its both ends protruding a little from both ends of the outer tube 1 by means of a plastic injecting moulding process.

The conductive member 3 is preferably fork-shaped at the rear portion, is fixed lengthwise through the body of the insulator 2, and has its end portion protruding out of the front end 3 of the insulator 2 for connection with a wire by means of soldering. The end portion of the conductive member 3 can be vertical, parallel or inclined to the end surface of the insulator 2.

The outer tube 1 can also be made of a mono-diametrical tube instead of a double-diametrical one, having the conductive member or flange 111 formed with the tube 1 as one unit.

I claim:

1. An electronic plug comprising:

an outer metal tube having first and second ends, said outer tube being formed from two separate metal tubes having different internal diameters and which are fixedly secured together;

an insulator fixedly secured within said outer metal tube, said insulator projecting beyond both of said first and second ends of said outer tube; and a single conductive member fixedly secured within said insulator, said conductive member having a first terminal end projecting out of said insulator and adapted to be connected to a wire and a second end, said second end being forked and terminating within said insulator.

2. An electronic plug as claimed in claim 1, further including a conductive flange integrally formed with and projecting radially outward from said first end of said outer tube.

3. An electronic plug as claimed in claim 2 wherein said insulator is injection molded within said outer tube.

* * * * *